US011680588B2

(12) United States Patent
Lanum et al.

(10) Patent No.: US 11,680,588 B2
(45) Date of Patent: Jun. 20, 2023

(54) LUBRICATION SYSTEM FOR A COMPRESSOR

(71) Applicant: Joy Global Surface Mining Inc, Milwaukee, WI (US)

(72) Inventors: Michael D. Lanum, Kenosha, WI (US); John Kenneth Luvaas, Mequon, WI (US); Scott R. McMahon, Wauwatosa, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 32 days.

(21) Appl. No.: 17/236,719

(22) Filed: Apr. 21, 2021

(65) Prior Publication Data

US 2021/0324859 A1 Oct. 21, 2021

Related U.S. Application Data

(60) Provisional application No. 63/013,334, filed on Apr. 21, 2020.

(51) Int. Cl.

| | |
|---|---|
| ***F15B 11/072*** | (2006.01) |
| ***F04C 29/02*** | (2006.01) |
| ***F15B 1/26*** | (2006.01) |
| ***F04C 29/04*** | (2006.01) |

(Continued)

(52) U.S. Cl.

CPC ..... *F15B 11/0725* (2013.01); *F04C 28/24* (2013.01); *F04C 29/026* (2013.01); *F04C 29/04* (2013.01); *F15B 1/265* (2013.01); *F15B 11/06* (2013.01); *F15B 11/072* (2013.01); *F04C 2210/1005* (2013.01); *F04C 2240/809* (2013.01)

(58) Field of Classification Search

CPC ..... F15B 1/26; F15B 1/265; F15B 11/072; F15B 11/0725; F04C 29/026

See application file for complete search history.

(56) References Cited

U.S. PATENT DOCUMENTS

| | | | |
|---|---|---|---|
| 3,936,249 | A | 2/1976 | Sato |
| 4,262,775 | A | 4/1981 | Webb |
| 4,394,113 | A | 7/1983 | Bammert |

(Continued)

FOREIGN PATENT DOCUMENTS

| | | | |
|---|---|---|---|
| CN | 1869514 | A | 11/2006 |
| CN | 102996455 | A | 3/2013 |

(Continued)

OTHER PUBLICATIONS

Chilean Patent Office Action and Search Report for Application No. 202101019 dated Jun. 8, 2022 (16 pages including an English statement of relevance).

(Continued)

*Primary Examiner* — Michael Leslie

(74) *Attorney, Agent, or Firm* — Husch Blackwell LLP

(57) ABSTRACT

A lubrication system is provided for supplying lubricant to an air compressor. The air compressor is driven by a drive system. The lubrication system includes a reservoir configured to support lubricant and configured to receive pressurized air from the air compressor, the separator reservoir configured to separate lubricant from the air received from the air compressor; and a motor operably coupled to the drive system and configured to receive pressurized lubricant. The motor is configured to transmit power to the drive system in at least one operating condition.

24 Claims, 8 Drawing Sheets

(51) Int. Cl.
*F04C 28/24* (2006.01)
*F15B 11/06* (2006.01)

(56) References Cited

U.S. PATENT DOCUMENTS

| | | | |
|---|---|---|---|
| 4,964,790 | A | 10/1990 | Scott |
| 5,765,392 | A | 6/1998 | Baur |
| 6,860,730 | B2 | 3/2005 | Lappanen |
| 6,981,855 | B2 | 1/2006 | Lappanen |
| 8,046,990 | B2 | 11/2011 | Bollinger et al. |
| 8,512,019 | B2 | 8/2013 | Kakiuchi et al. |
| 10,197,316 | B2 | 2/2019 | Larminat et al. |
| 10,273,962 | B2 | 4/2019 | Mate et al. |
| 10,851,941 | B2 | 12/2020 | Wilson et al. |
| 2008/0085207 | A1 | 4/2008 | Mosemann et al. |
| 2008/0206085 | A1 | 8/2008 | Zieglgansberger |
| 2011/0314830 | A1 | 12/2011 | Legare |
| 2016/0040491 | A1 | 2/2016 | Law et al. |
| 2019/0072093 | A1 | 3/2019 | Tajima et al. |
| 2019/0072095 | A1 | 3/2019 | Lanum et al. |
| 2019/0120369 | A1 | 4/2019 | Staake et al. |

FOREIGN PATENT DOCUMENTS

| | | | |
|---|---|---|---|
| CN | 206175227 | U | 5/2017 |
| CN | 206988105 | U | 2/2018 |
| CN | 109322830 | A | 2/2019 |
| CN | 211231353 | U | 8/2020 |
| DE | 242255 | A1 | 1/1987 |
| DE | 102006034721 | A1 | 1/2008 |
| EP | 464315 | B1 | 6/1993 |
| ES | 2362621 | T3 | 7/2011 |
| ES | 2709337 | T3 | 4/2019 |
| GB | 2367334 | A | 4/2002 |
| JP | H08121368 | A | 5/1996 |
| JP | H09100781 | A | 4/1997 |
| KR | 20140103674 | A | 8/2014 |
| MX | 2017010212 | A | 11/2017 |
| RU | 2445513 | C1 | 3/2012 |
| WO | 2005035989 | A1 | 4/2005 |
| WO | 2009030471 | A1 | 3/2009 |

OTHER PUBLICATIONS

Chinese Patent Office Action and Search Report for Application No. 201811036428 6 dated Apr. 25, 2022 (19 pages including English translation).

Sandvik Mining, "Reduce Environmental Impact. This Way! Compressor Management System", Brochure, 2012, 5 pages.

Fiscor, "New System Manages Main Compressor on Rotary Drills", Coal Age, 2011, 4 pages.

World Coal, "Breathing New Life", Sandvik Case Study, 2013, 3 pages.

Chilean Patent Office Action and Search Report for Application No. 202101019 dated Oct. 12, 2022 (14 pages, including an English statement of relevance).

LUBRICATION SYSTEM FOR A COMPRESSOR

REFERENCE TO RELATED APPLICATION

This patent application claims the benefit of prior-filed U.S. Provisional Patent Application No. 63/013,334, filed Apr. 21, 2020, the entire content of which is hereby incorporated by reference.

TECHNICAL FIELD

The present disclosure relates to compressors, and more particularly to lubrication systems for oil flooded screw compressors.

Oil flooded screw compressors typically include a set of rotors or screws that require fluid (e.g., oil) to seal between the rotors and to remove heat generated during compression. The rotors are supported on bearings that also typically require lubrication. Often, the required oil is supplied by an air/oil separator tank. Pressurized air discharged from the compressor flows into the separator tank, where entrained oil is separated from the air and collected in the tank. The separator tank is maintained at an elevated pressure while the compressor is operating, thereby driving oil to the compressor.

SUMMARY

Some machine operations (e.g., down-the-hole hammer drilling) require high air pressure (e.g., at or above 175 psi, and up to 500 psi in some cases) to operate a tool such as a drill bit hammer. Since the air compressor oil lubricating system uses air pressure to drive oil through oil coolers, all system components must be able to withstand the maximum operating pressure used plus a safety margin. As larger tools are developed and implemented, the maximum operating pressure increases, thereby requiring an increase in the size and complexity of cooling circuits that can withstand these operating pressures and still provide adequate cooling. Designing and fabricating large coolers that are capable of withstanding high operating pressures is difficult, and in some cases not economically feasible.

In one independent aspect, an industrial machine includes a working tool; an air supply system for supplying pressurized air for operating the tool, the air supply system including an air compressor supplying pressurized air at an output; a drive system for driving at least the air compressor; and a lubrication system for supplying lubricant to the air compressor. The lubrication system includes a reservoir configured to support lubricant, the reservoir configured to receive pressurized air from the air compressor; and a motor operably coupled to the drive system and configured to receive pressurized lubricant, flow of lubricant driving the motor to transmit power to the drive train in at least one operating condition.

In another independent aspect, a lubrication system is provided for supplying lubricant to an air compressor. The air compressor is driven by a drive system. The lubrication system includes a separator reservoir configured to support lubricant and configured to receive pressurized air from the air compressor, the separator reservoir configured to separate lubricant from the air received from the air compressor; and a motor operably coupled to the drive system and configured to receive pressurized lubricant. The motor is configured to transmit power to the drive system in at least one operating condition.

In yet another independent aspect, a lubrication system is provided for supplying lubricant to an air compressor for a drill. The air compressor is driven by a drive system. The lubrication system includes a separator reservoir configured to support lubricant and configured to receive pressurized air from the air compressor, the separator reservoir configured to separate lubricant from the air received from the air compressor; a cooler configured to reduce a temperature of the lubricant being driven to the air compressor; and a motor operably coupled to the drive system and configured to receive pressurized lubricant. The motor is configured to transmit power to the drive system in a first mode in which pressure of the air in the reservoir is sufficient to drive the lubricant from the reservoir through the motor. The motor is configured to be driven by the drive system to drive the lubricant in a second mode in which pressure of the air in the reservoir is insufficient to drive the lubricant from the reservoir and through the motor.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

The present disclosure relates to a system for cooling and/or lubricating an air compressor. The system includes a regenerative circuit that is operable to reduce pressure of the cooling fluid/lubricant and is capable of capturing energy from the cooling fluid/lubricant to supplement a drive train, thereby increasing reliability and safety, lowering cost, and reducing power consumption.

Figure 1:
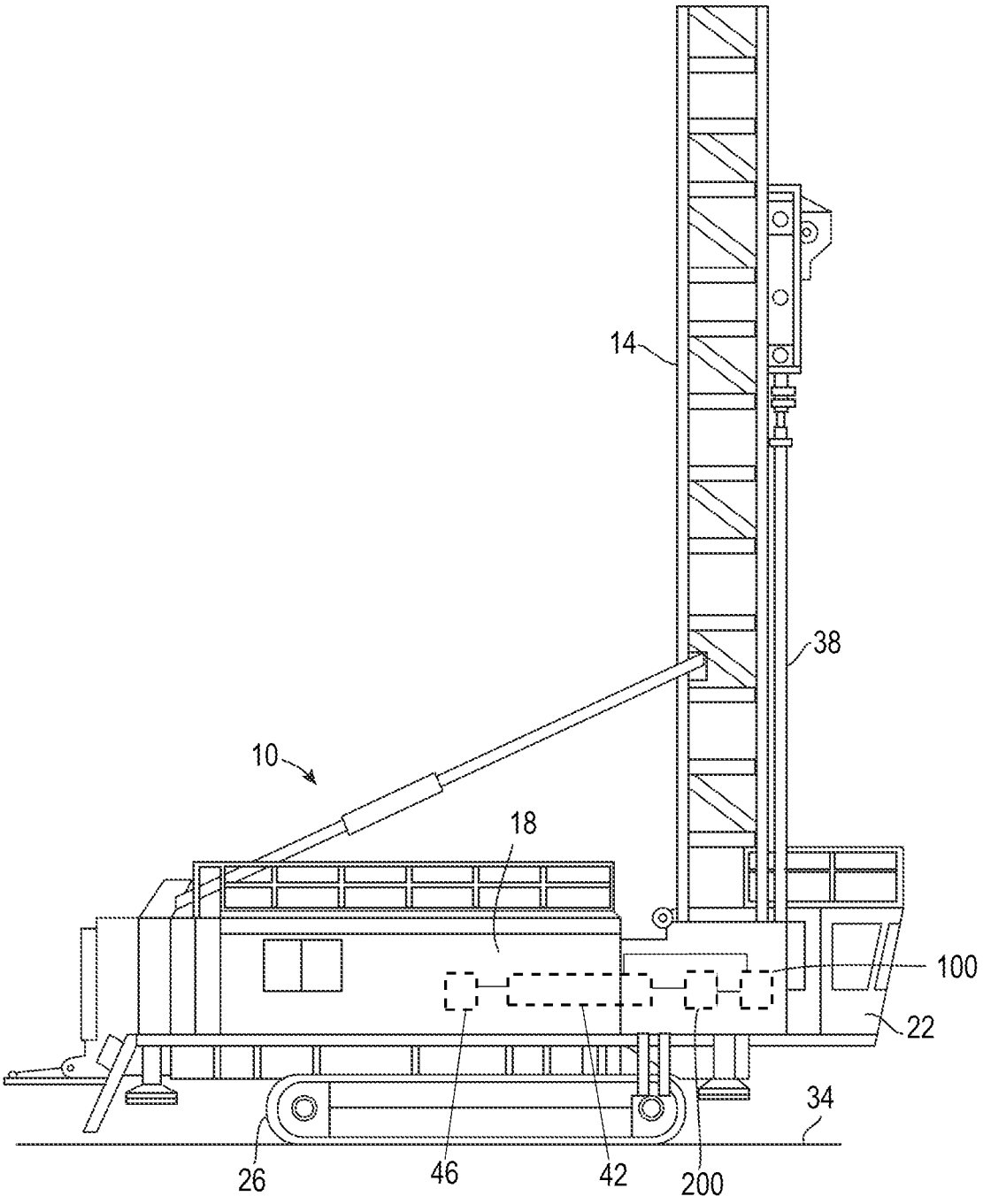
FIG. 1 is a side view of an industrial machine.

FIG. 1 illustrates a machine 10. In the illustrated embodiment, the machine 10 is a blasthole drill; however, in other embodiments, the machine 10 may be a different type of drill or any other type of machine requiring compressed air, including mining equipment, construction equipment, and the like. The illustrated blasthole drill 10 includes a drill tower 14, a base 18 (e.g., a machinery house) supporting the drill tower 14, an operator's cab 22 coupled to the base 18, and traction devices (e.g., crawlers) 26 configured to move the drill 10 along a ground surface 34. The drill tower 14 is coupled to and supports a drill pipe 38 (e.g., with a drill bit, not shown), which is configured to extend vertically downward through the ground 34 and into a borehole. The machine 10 further includes a drive train 42 for providing power from a prime mover 46 to various components of the machine, including the traction devices 26 and the drill pipe 38.

An air compressor 100 is supported by the base 18 and is operable to generate compressed air that may be used, for example, for flushing bit cuttings from the bottom of the borehole to the surface. A lubrication system 200 is also supported by the base 18 and is operable to provide oil to the air compressor 100, as described below.

Figure 2:
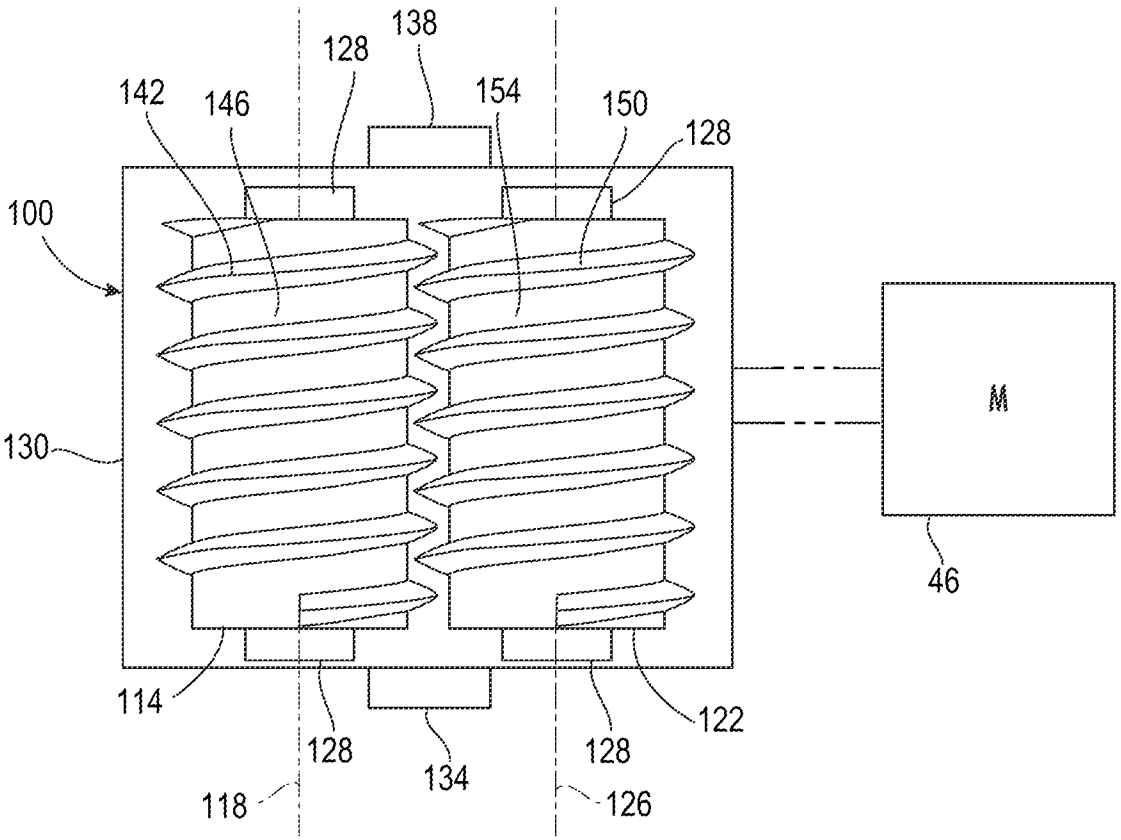
FIG. 2 is a schematic view of an air compressor operable with the industrial machine of FIG. 1.

As shown in FIG. 2, in some embodiments an oil flooded rotary screw air compressor 100 includes a main rotor or screw 114 that rotates about a first axis 118 and a secondary rotor or screw 122 that rotates about a second axis 126. The rotors 114, 122 are each supported on low-friction bearings 128 and disposed in a stator housing 130. The rotors 114, 122 are driven by a power source (e.g., the prime mover 46 or a motor). The rotors 114, 122 may be coupled to the prime mover 46 by any suitable power transfer mechanism, such as a transmission, power take-off shaft, torque converter, direct drive, and the like. In other embodiments, the compressor 100 may include more than two rotors, or the compressor 100 may include a single rotor.

The stator housing 130 includes an air inlet port 134 and an air outlet port 138. The main rotor 114 has helical lobes 142 and grooves 146 along its length, while the secondary rotor 122 has corresponding helical lobes 150 and grooves 154. Air flowing in through the inlet port 134 fills spaces between the helical lobes 142, 150 on each rotor 114, 122. Rotation of the rotors 114, 122 causes the air to be trapped between the lobes 142, 150 and the stator housing 130. As rotation continues, the lobes 142 on the main rotor 114 roll into the grooves 154 on the secondary rotor 122 and the lobes 150 on the secondary rotor 122 roll into the grooves 146 on the main rotor 114, thereby reducing the space occupied by the air and resulting in increased pressure. Compression continues until the inter-lobe spaces are exposed to the air outlet port 138 where the compressed air is discharged.

The illustrated compressor 100 is a single stage compressor; however, in other embodiments, the compressor 100 may have multiple stages. In some embodiments, the compressor 100 has a maximum output pressure at the air outlet port 138 of 500 psi. In other embodiments, the compressor 100 has a maximum output pressure at the air outlet port 138 less than 500 psi. In other embodiments, the compressor 100 has a maximum output pressure at the air outlet port 138 between 200 psi and 500 psi. In some embodiments, the compressor 100 has a maximum discharge volume of 3,800 cubic feet per minute (CFM). In other embodiments, the compressor 100 has a maximum discharge volume less than 3,800 CFM. In other embodiments, the compressor 100 has a maximum discharge volume between 1,000 CFM and 3,800 CFM.

Figure 3:
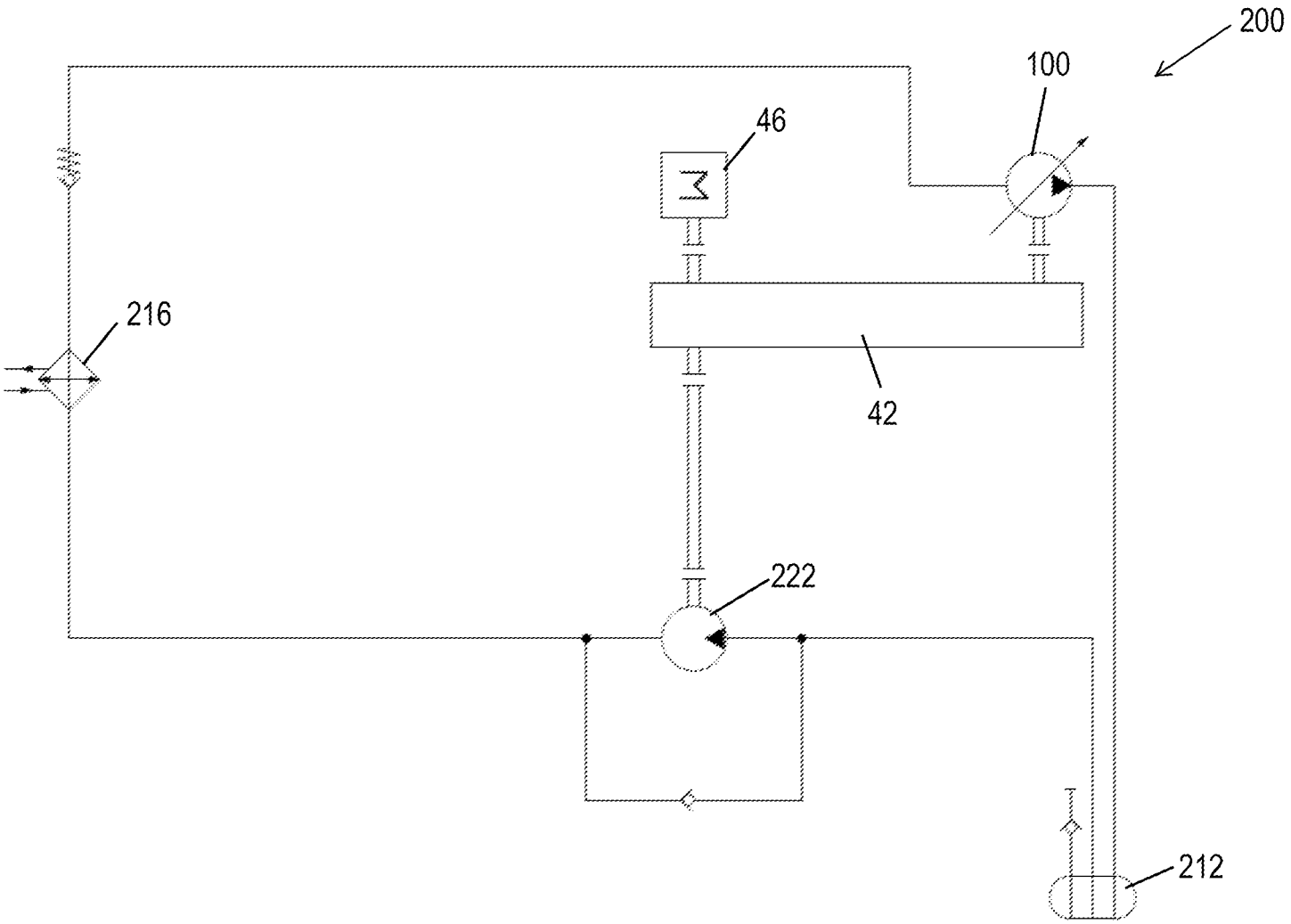
FIG. 3 is a schematic view of a lubrication system operable with the air compressor of FIG. 2.

FIG. 3 illustrates a lubrication system 200, according to one embodiment, that can be used to supply lubricant to the compressor 200 illustrated in FIG. 1. In some embodiments, the lubricant is a petroleum-based or synthetic oil; in other embodiments, the lubricant may be any lubricant that is appropriate for use in a flooded compressor, such as the compressor 100. The lubricant is supplied directly to the compressor 200 to lubricate and/or cool the components of the compressor 200.

The illustrated lubrication system 200 includes an air compressor receiver tank 212 and a cooler 216. These components are coupled together by fluid transfer components, such as piping, valving, and/or metering devices. It should be understood that the arrangement, selection, and number of fluid transfer components may be varied as would be understood by one of ordinary skill in the art. In the illustrated embodiment, the receiver tank 212 receives (either directly or indirectly) pressurized air from the air compressor and is a separator tank capable of separating lubricant from the pressurized air.

In the illustrated embodiment, a motor 222 (e.g., a fixed displacement hydraulic motor) is positioned between the receiver tank 212 and the cooler 216. The motor 222 is coupled to the drive train 42, and operation of the motor 222 provides additional power to the drive train 42. That is, the motor 222 is capable of transmitting power to the drive train 42. During operation, air pressure in the tank 212 may drive lubricant from the tank 212 and to the air compressor 100, through the motor 222 and cooler 216. In some conditions, the fluid drives the motor 222, transmitting some power back to the drive train 42. The power transmitted to the drive train may be in the form of rotational energy. In addition, the pressure of the fluid leaving the motor 222 is reduced before passing through the cooler 216.

Operational air pressure in the air tank 212 pushes hot lubricating oil from the air tank 212 to the motor 222 via connecting hoses and/or tubes. The motor 222 is connected to the air compressor prime mover drive train 42. As the prime mover 46 rotates, the motor 222 rotates at a speed proportional to the prime mover 46 and driven air compressor 100, thus ensuring lubricant flow from the air tank 212 to the air compressor 100. In some operating conditions (e.g., when operational system pressure is high or above a threshold), the motor 222 is driven by flow of the pressurized lubricant. As the lubricant drives the motor 222, the pressure of the lubricant is reduced at the motor outlet as the potential energy of the lubricant is converted into rotational energy of the motor 222 that is transmitted back into the prime mover drivetrain 42. Unlike other types of pressure-reducing devices (e.g., valves and orifices), the lubrication system 200 captures energy that is not necessary for cooling and supplies it back to the drive train 42. In one embodiment, an air system operating at 500 psi that requires an oil flow of 100 gallons per minute for cooling can regenerate 17.5 horsepower back into the drivetrain (minus inefficiencies) when the motor outlet to the oil cooler is 200 psi. The operation of the motor 222 (including the conditions in which it is activated to transmit power to the drive train 42) may vary depending on the operating conditions of the industrial machine and the lubrication system.

Furthermore, the lubricant pressure exiting the motor 222 is reduced, thereby enabling the system 200 to be operated with components having a lower pressure rating. Among other things, the use of lower-rated components reduces cost, increases reliability (e.g., due to less system fatigue), and increases safety.

As the operational air pressure in the air tank 212 decreases (e.g., when the pressure is relatively low), the need for lubricant for the air compressor 100 decreases. In some embodiments, the motor 222 is capable of transitioning to operating as a lubricant pump in some operating conditions (e.g., when operational system pressure is low or below a threshold). The pump/motor 222 may be driven by the drive train 42 to ensure an adequate flow to the air compressor 100 for cooling and lubrication. That is, in some embodiments the connection between the drive train 42 and the motor 222 permits power transmission in two directions (i.e., the connection is bi-directional). The threshold at which the pump/motor 222 transitions (including the conditions in which it is activated to transmit power to the drive train 42 or receive power from the drive train 42) may vary depending on the operating conditions of the industrial machine and the lubrication system. In other embodiments, the motor 222 may act as a motor only, regardless of the system pressure. Stated another way, in some embodiments, the motor 222 may operate in a single mode as a motor transmitting power to the drive train 41; in other embodiments, the motor 222 may be a pump/motor that operates as a motor in a first mode and operates as a pump in a second mode.

Figure 4:
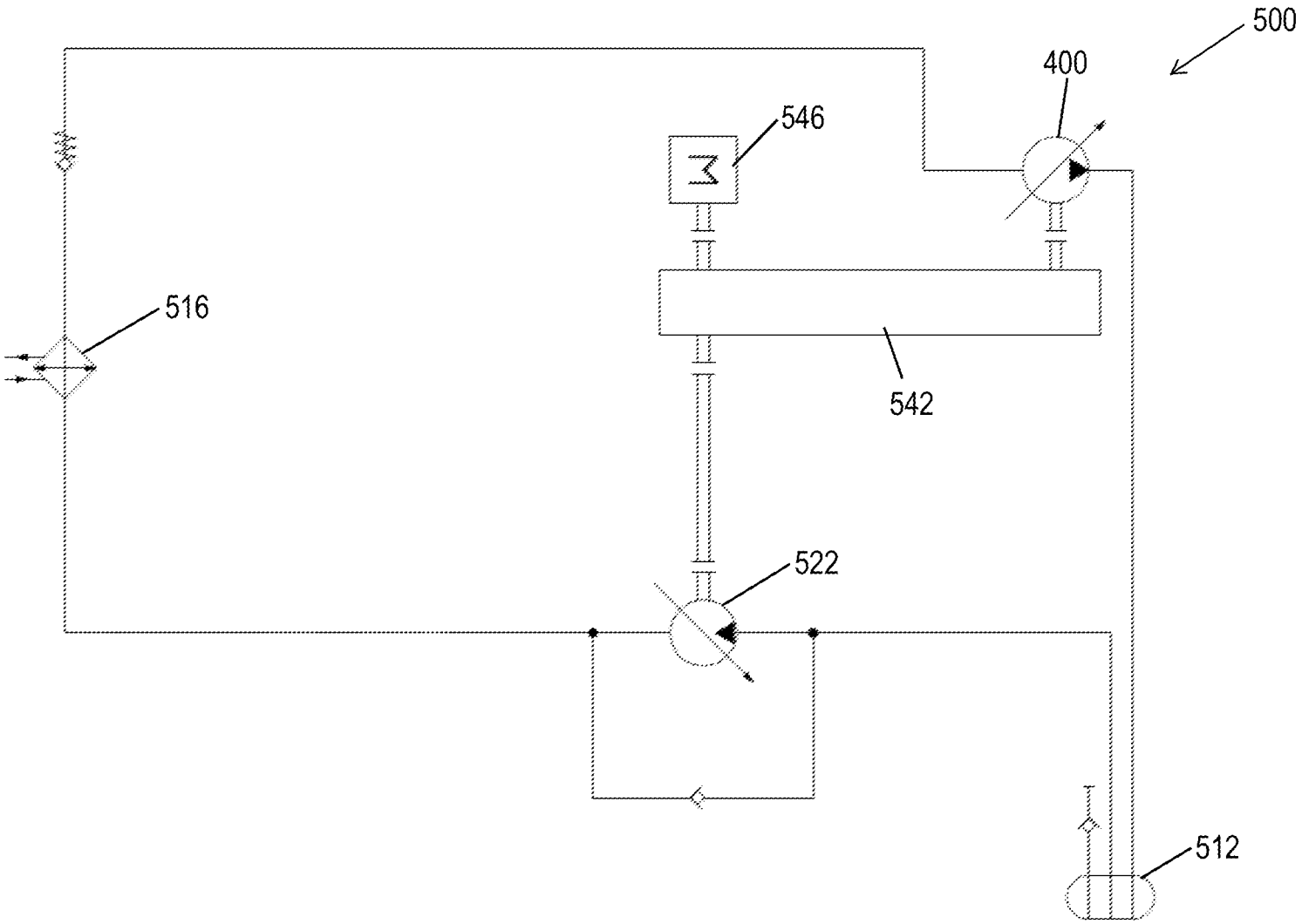
FIG. 4 is a schematic view of a lubrication system according to another embodiment, operable with the air compressor of FIG. 2.

FIG. 4 illustrates a system 500 according to another embodiment. The system 500 is similar to the system 200 described above with respect to FIG. 3, and similar components are illustrated with similar reference numbers, plus 300 or plus 500. Some differences between the system 500 and the system 200 are described.

The system 500 includes a variable displacement hydraulic motor 522 positioned between a tank 512 and a cooler 516. The output requirements of the air system can vary, and often the speed of a compressor 400 must be adjusted accordingly. Changes in the speed of the compressor 400 impacts the flow of lubricant. The motor 522 can be adjusted to vary the amount of displaced fluid to match system flow and allow maximization of energy return to the drive train 542. In addition, motor displacement can be adjusted to control outlet pressure from the motor 522, thereby limiting pressure of the fluid passing to the cooler 516.

Figure 5:
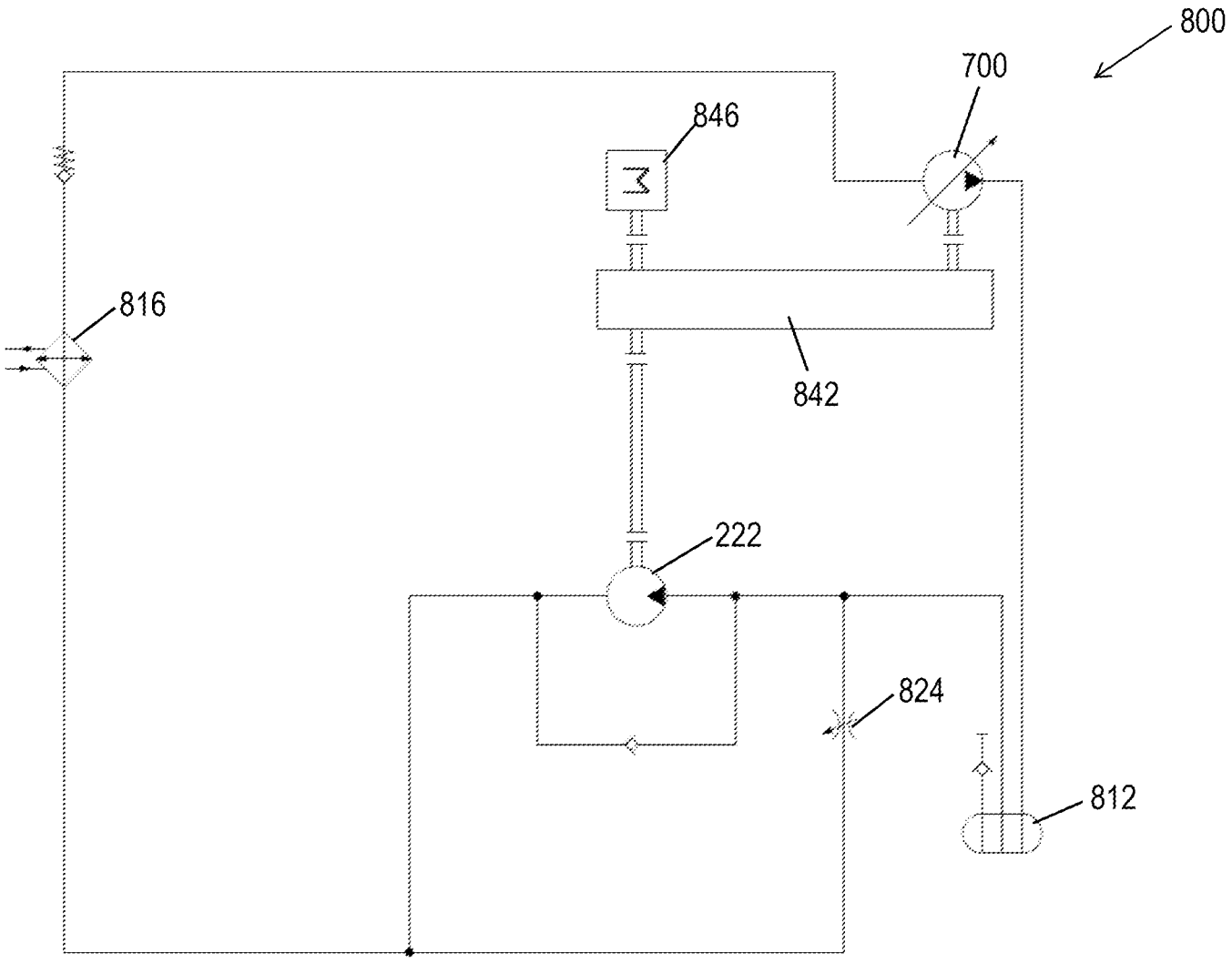
FIG. 5 is a schematic view of a lubrication system according to yet another embodiment, operable with the air compressor of FIG. 2.

FIG. 5 illustrates a system 800 according to another embodiment. The system 800 is similar to the system 200 described above with respect to FIG. 3, and similar components are illustrated with similar reference numbers, plus 600 or plus 800. Some differences between the system 800 and the system 200 are described.

The system 800 includes a motor 222 positioned between a tank 812 and a cooler 816. In addition, a variable orifice 824 is positioned in parallel with the motor 222. The variable orifice 824 reduces the effects of pressure and flow fluctuations, thereby increasing the working life of the cooler 816 and the motor 222.

Figure 6:
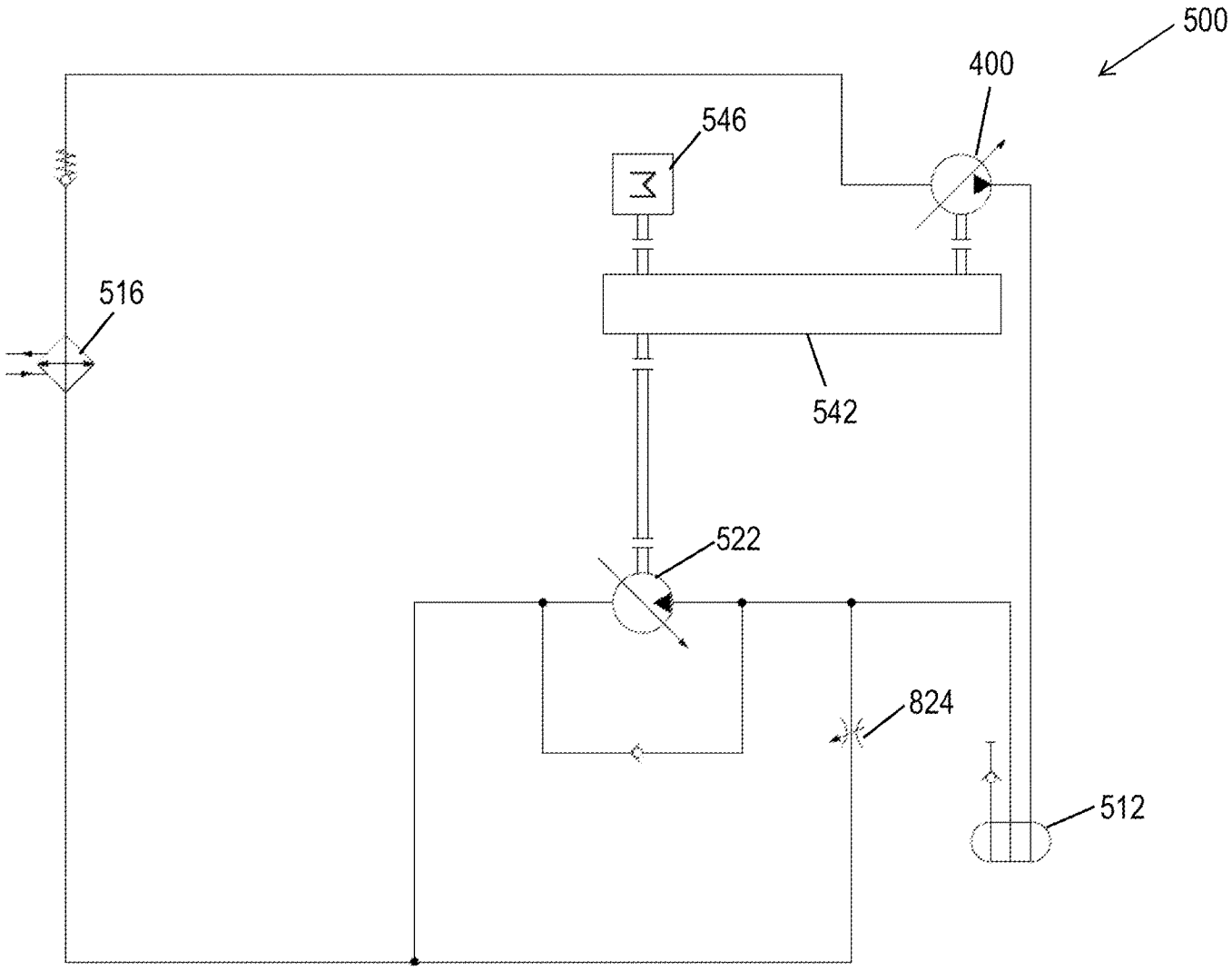
FIG. 6 is a schematic view of a lubrication system according to still another embodiment, operable with the air compressor of FIG. 2.

As shown in FIG. 6, in other embodiments, the variable orifice 824 is incorporated into the system 500 including a variable displacement motor 522. The combination of the variable orifice 824 and variable displacement motor 522 can optimize pressure and flow through the system 800 to limit damaging pressure and flow fluctuations, while permitting adjustments to maximize energy return to a drive train 542.

Figure 7:
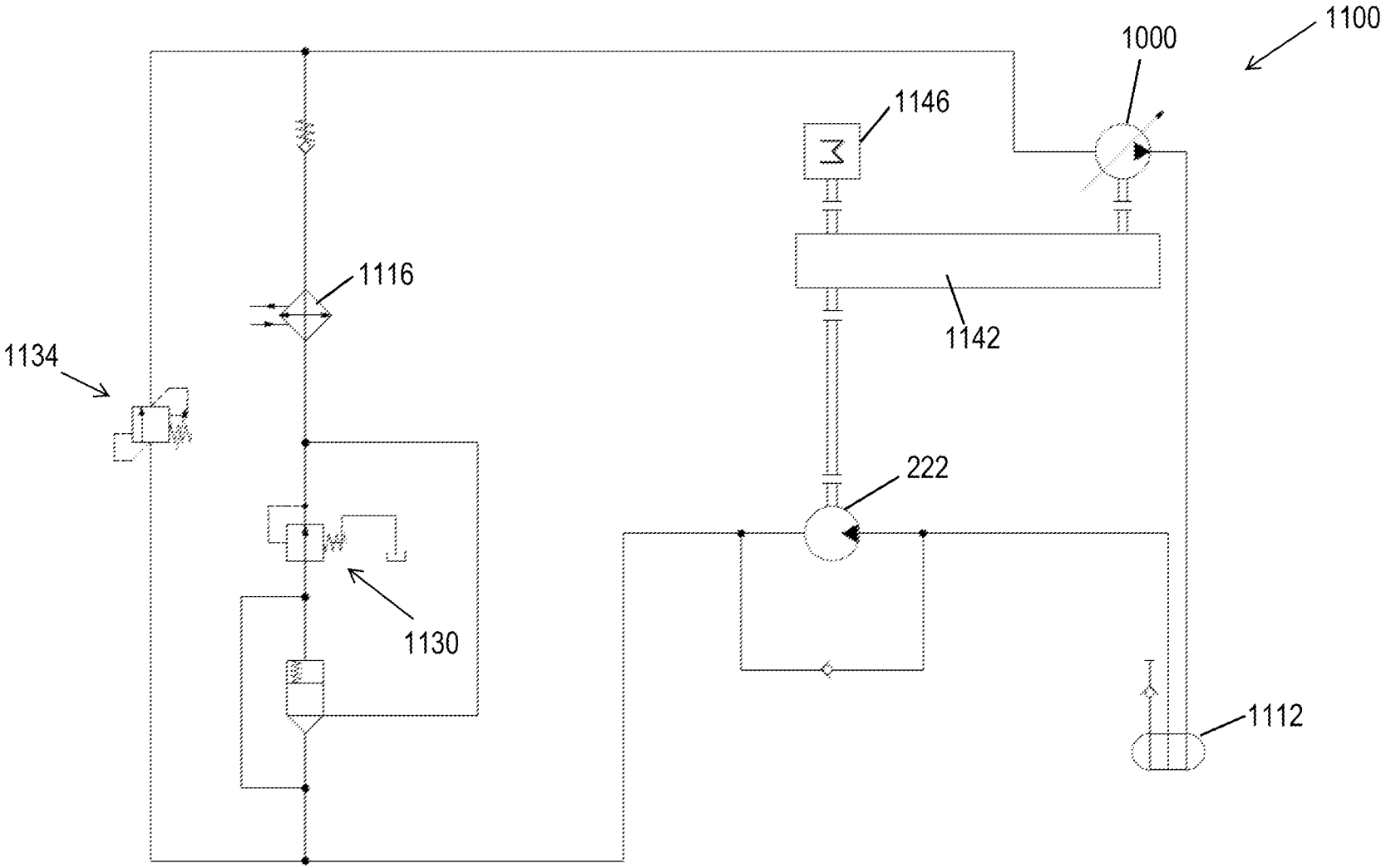
FIG. 7 is a schematic view of a lubrication system according to yet another embodiment, operable with the air compressor of FIG. 2.

FIG. 7 illustrates a system 1100 according to another embodiment. The system 1100 is similar to the system 200 described above with respect to FIG. 3, and similar components are illustrated with similar reference numbers, plus 900 or plus 1100. Some differences between the system 1100 and the system 200 are described.

The system 1100 includes a motor 222 positioned between a tank 1112 and a cooler 1116. In addition, a pressure reducing valve 1130 and relief valve 1134 are positioned downstream of a fixed displacement motor 222. The valves 1130, 1134 permit greater fluctuations in pressure and flow while also protecting the cooler 1116. In addition, the valves 1130, 1134 reduce constraints on the size of the motor 222, permitting greater flexibility in selection of the motor 222.

Figure 8:
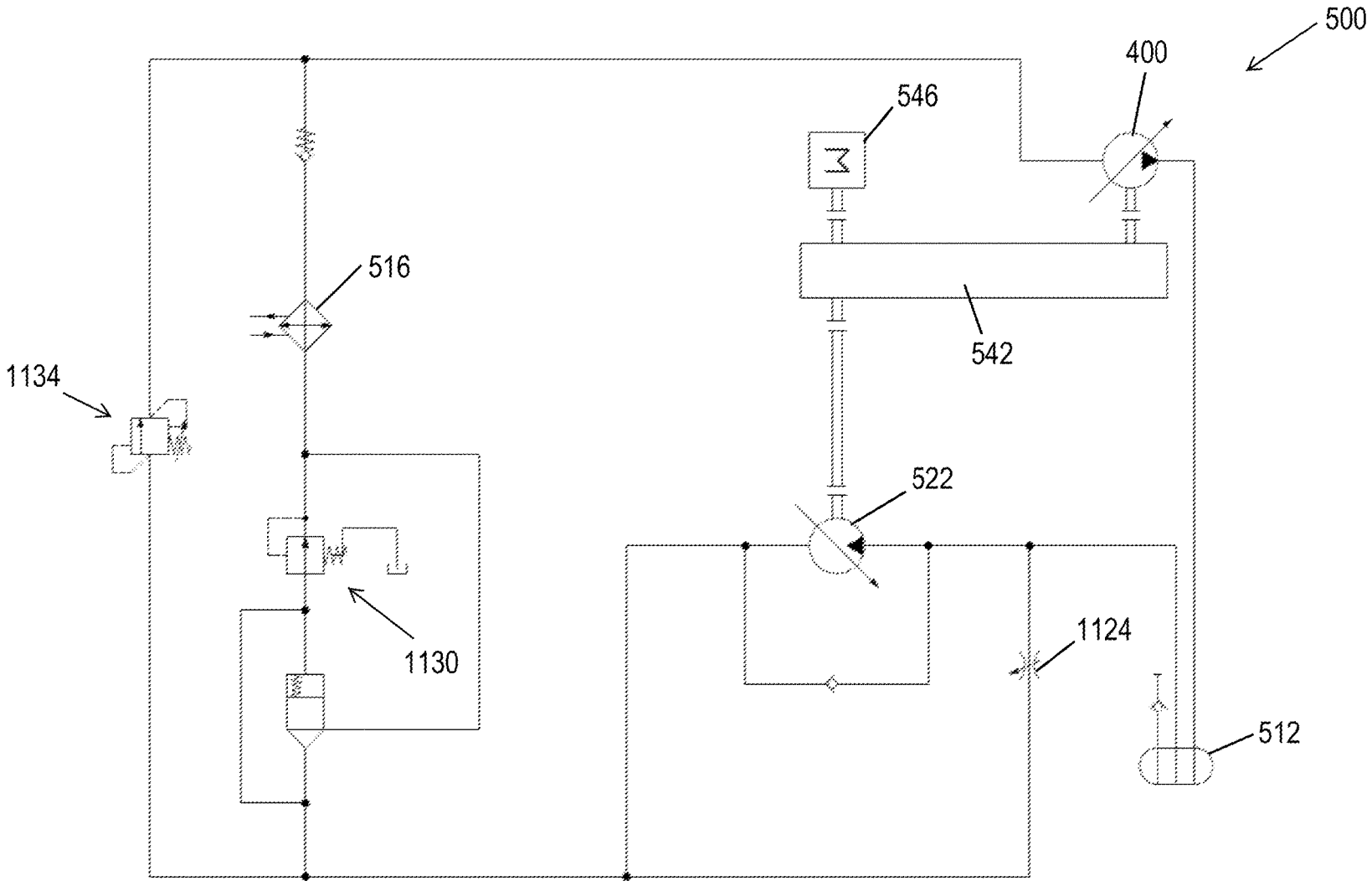
FIG. 8 is a schematic view of a lubrication system according to still another embodiment, operable with the air compressor of FIG. 2.

As shown in FIG. 8, in other embodiments, the pressure reducing valve 1130, a relief valve 1134, and a variable orifice 1124 are incorporated into the system 500 including a variable displacement motor 522. The valves 1130, 1134 permit greater fluctuations in pressure and flow while also protecting the cooler 216. In addition, the combination of the variable orifice 1124 and the variable displacement motor 522 can optimize pressure and flow through the system 1100 to limit damaging pressure and flow fluctuations, while permitting adjustments to maximize energy return to the drive train 1142.

Although the disclosure has been described in detail with reference to certain embodiments, variations and modifications exist within the scope and spirit of one or more independent aspects as described. Various features of the disclosure are set forth in the following claims.

What is claimed is:

1. An industrial machine comprising:

a working tool;

an air supply system for supplying pressurized air for operating the tool, the air supply system including an air compressor supplying pressurized air at an output;

a drive system for driving at least the air compressor; and a lubrication system for supplying lubricant to the air compressor, the lubrication system including:

a reservoir configured to support lubricant, the reservoir configured to receive pressurized air from the air compressor; and a motor operably coupled to the drive system and configured to receive pressurized lubricant, flow of lubricant driving the motor to transmit power to the drive system in at least one operating condition.

2. The industrial machine according to claim 1, wherein, while pressure of the air in the reservoir is sufficient to drive the lubricant from the reservoir through the motor, the flow of lubricant drives the motor, thereby reducing pressure of the lubricant at a motor outlet and transmitting energy to the drive system.

3. The industrial machine according to claim 1, wherein the industrial machine is a drill and the drive system also drives at least one other component of the drill.

4. The industrial machine according to claim 3, wherein the reservoir is a separator reservoir configured to support lubricant, the separator reservoir receiving pressurized air from the air compressor and separating separate lubricant from the pressurized air.

5. The industrial machine according to claim 1, wherein the lubrication system includes a cooler configured to reduce a temperature of the lubricant being driven to the air compressor.

6. The industrial machine according to claim 1, wherein the motor is a fixed displacement motor.

7. The industrial machine according to claim 1, wherein the motor is a variable displacement motor.

8. The industrial machine according to claim 1, wherein, while pressure of the air in the reservoir is insufficient to drive the lubricant from the reservoir and through the motor, the motor is driven by the drive system and acts as a pump to drive the lubricant to the air compressor.

9. The industrial machine according to claim 1, wherein the lubrication system further includes a fluid circuit fluidly connecting and configured to pass the lubricant between: the reservoir, the cooler, the motor, and the air compressor.

10. The industrial machine according to claim 1, wherein the lubrication system further includes a variable orifice connected in parallel with respect to the motor.

11. The industrial machine according to claim 1, wherein the lubrication system further includes a pressure reducing valve and a relief valve in parallel with one another.

12. A lubrication system for supplying lubricant to an air compressor, the air compressor driven by a drive system, the lubrication system comprising:

a separator reservoir configured to support lubricant and configured to receive pressurized air from the air compressor, the separator reservoir configured to separate lubricant from the air received from the air compressor; and a motor operably coupled to the drive system and configured to receive pressurized lubricant, the motor being configured to transmit power to the drive system in at least one operating condition.

13. The lubrication system according to claim 12, wherein the operating condition is a first operating condition in which pressure of the air in the reservoir is sufficient to drive the lubricant from the reservoir through the motor, wherein the motor is configured to be driven by the drive system to act as a pump to drive the lubricant in a second operating condition in which pressure of the air in the reservoir is insufficient to drive the lubricant from the reservoir and through the motor.

14. The lubrication system according to claim 12, wherein the lubrication system includes a cooler configured to reduce a temperature of the lubricant being driven to the air compressor.

15. The lubrication system according to claim 14, wherein the lubrication system further includes a fluid circuit fluidly connecting and configured to pass the lubricant between: the reservoir, the cooler, the motor, and the air compressor.

16. The lubrication system according to claim 12, wherein the motor is a fixed displacement motor.

17. The lubrication system according to claim 12, wherein the motor is a variable displacement motor.

18. The lubrication system according to claim 12, wherein the lubrication system further includes a variable orifice connected in parallel with respect to the motor.

19. The lubrication system according to claim 12, wherein the lubrication system further includes a pressure reducing valve and a relief valve in parallel with one another.

20. A lubrication system for supplying lubricant to an air compressor for a drill, the air compressor driven by a drive system, the lubrication system comprising:

a separator reservoir configured to support lubricant and configured to receive pressurized air from the air compressor, the separator reservoir configured to separate lubricant from the air received from the air compressor;

a cooler configured to reduce a temperature of the lubricant being driven to the air compressor; and a motor operably coupled to the drive system and configured to receive pressurized lubricant, the motor being configured to transmit power to the drive system in a first mode in which pressure of the air in the reservoir is sufficient to drive the lubricant from the reservoir through the motor, the motor being configured to be driven by the drive system to drive the lubricant in a second mode in which pressure of the air in the reservoir is insufficient to drive the lubricant from the reservoir and through the motor.

21. The industrial machine according to claim 1, wherein the motor is positioned between a tank and a cooler.

22. The industrial machine according to claim 1, wherein the motor is a variable displacement motor, the motor being adjustable to vary the amount of displaced fluid to match system flow and to control outlet pressure from the motor.

23. The industrial machine according to claim 1, wherein a variable orifice is positioned in parallel with the motor.

24. The industrial machine according to claim 1, wherein the motor is a fixed displacement motor, and wherein the lubrication system includes a pressure reducing valve and relief valve positioned downstream of the fixed displacement motor.

* * * * *